United States Patent [19]

Heinrich et al.

[11] 4,021,520

[45] May 3, 1977

[54] PROCESS FOR THE MANUFACTURE OF FILAMENT YARN HAVING PROTRUDING FILAMENT ENDS

[75] Inventors: Karl Heinrich; Fritz Schneider, both of Bobingen, Germany

[73] Assignee: Hoechst Aktiengesellschaft, Frankfurt am Main, Germany

[22] Filed: Mar. 12, 1974

[21] Appl. No.: 450,438

[30] Foreign Application Priority Data

Mar. 17, 1973 Germany ..... 2313473

[52] U.S. Cl. ..... 264/103; 19/.37; 264/138; 264/151; 264/267; 264/290 T

[51] Int. Cl.[2] ..... D01G 1/00

[58] Field of Search ..... 264/167, 103, 168, 234, 264/210 F, 138, 290 T, 290 N, 290 R, 151; 28/1.2, 1.3, 78.1; 19/.37, .39, .43, .35, .41, .46

[56] References Cited

UNITED STATES PATENTS

| | | | |
|---|---|---|---|
| 2,003,400 | 6/1935 | Taylor et al. | 57/157 S |
| 2,244,281 | 6/1941 | Alibert | 264/207 |
| 2,278,879 | 4/1942 | Hunter | 264/210 F |
| 2,296,394 | 9/1942 | Meloon | 57/140 J |
| 2,313,630 | 3/1943 | Dockerty | 264/168 |
| 2,435,891 | 2/1948 | Lodge | 264/168 |
| 2,638,634 | 5/1953 | Hare | 19/.37 |
| 2,975,474 | 7/1961 | Smith | 264/167 |
| 3,069,726 | 12/1962 | Adams | 264/290 |
| 3,154,807 | 11/1964 | Muller et al. | 28/71.3 |
| 3,212,158 | 10/1965 | Kasey | 28/74 |
| 3,293,843 | 12/1966 | Bibby et al. | 57/157 |
| 3,379,808 | 4/1968 | McZutosh et al. | 264/293 |
| 3,388,198 | 6/1968 | Sims | 264/210 F |
| 3,487,619 | 1/1970 | Fields | 264/210 F |
| 3,495,295 | 2/1970 | Farrand et al. | 28/71.3 |
| 3,523,345 | 8/1970 | Hughes | 264/168 |
| 3,594,881 | 7/1971 | Barber et al. | 28/71.3 |
| 3,673,650 | 7/1972 | Cerutti | 28/72.1 |
| 3,785,017 | 1/1974 | Jacob et al. | 28/1.2 |

FOREIGN PATENTS OR APPLICATIONS

| | | | |
|---|---|---|---|
| 45-34770 | 11/1970 | Japan | 264/168 |
| 306,591 | 12/1968 | Sweden | 28/1.3 |
| 291,120 | 5/1928 | United Kingdom | 28/1.3 |
| 852,291 | 10/1960 | United Kingdom | 19/.37 |

*Primary Examiner*—Jay H. Woo
*Attorney, Agent, or Firm*—Connolly and Hutz

[57] ABSTRACT

A process is provided for the manufacture of filament yarns having fine protruding filament ends, which comprises subjecting filament yarns, wherein at least part of the filaments consist of polymers the lateral bending resistance (Knickscheuerbestandigkeit) of which can be thermally influenced, to an intermittent sectional treatment, thus ensuring that determined sections of the filaments have a low lateral bending resistance, and by subsequently breaking these sections of low lateral bending resistance by transverse stress, which causes formation of the desired free filament ends.

2 Claims, No Drawings

PROCESS FOR THE MANUFACTURE OF FILAMENT YARN HAVING PROTRUDING FILAMENT ENDS

The present invention relates to a process for the manufacture of filament yarns of synthetic high polymers having fine protruding filament ends.

Filaments of synthetic high polymers are normally of a smooth nature and are processed to correspondingly plain woven or knitted fabrics which do not have the soft touch of woven or knitted fabrics made from spun fiber yarns. Obviously, the protruding ends of fiber yarns are decisive for the subjective estimation of textile shaped articles.

Therefore, a great number of processes for the manufacture of filament yarns having protruding filament ends, so-called hair yarns, have been developed, for example the process described in German Auslegeschrift No. 1,263,217, where filament yarns are mixed in an interlacing jet with yarns made from staple fibers. German Offenlegungsschrift No. 1,660,606 describes a process for the manufacture of such hair yarns, which comprises ripping and unravelling mechanically the surface of a drawn continuous filament by the action of rotating brushes. This process, however, is limited to foamed thermoplastic polymers, and it is obviously applicable to coarse yarns only.

Furthermore, it has been proposed to draw simultaneously filaments of different elongation in such a manner that one of the components breaks, thus resulting in a filament having protruding ends, such as it is described in British Patent No. 924,086. In this process, however, generally all filaments of the lower elongation break at one distinct spot of the yarn, so that a bunchy structure is the result instead of a uniform distribution of single filament ends over the whole filament surface.

The object of the present invention is therefore to provide a process for the manufacture of filament yarns on the basis of synthetic high polymers which yarns have fine protruding filament ends uniformly distributed over the surface of the filament yarn.

The object of this invention is accomplished by subjecting filament yarns, wherein at least part of the filaments consist of polymers the lateral bending resistance (Knickscheuerbestandigkeit) of which can be thermally influenced, to an intermittent sectional heat treatment, thus ensuring that determined sections of the filaments have a low lateral bending resistance, and by subsequently breaking these sections of low lateral bending resistance by transverse stress, which causes formation of the desired free filament ends.

In a special embodiment of the present invention, filament yarns wherein at least part of the filaments consist of polymers having a thermally influenceable lateral bending resistance are passed over the surface of a hot profiled roller the circumferential speed of which being the same as the speed of the running filaments, which causes determined sections of the filaments to contact intensely the surface of the hot profiled roller and thus to obtain a low lateral bending resistance, and subsequently these sections having a low lateral bending resistance are broken by transverse stress, which causes the formation of the free filament ends.

By hot profiled roller, there is to be understood any body the surface temperature of which is maintained at a temperature above the second order transition temperature of the polymer forming the filaments and which body is moved in such a manner that, at the area of contact with the filaments, the surface speed of the body is identical to the filament speed with respect to rate and direction, the surface of which body however being constructed in such a manner that it contacts the filaments not over their complete length, but only at determined sections.

A preferred shape of the profiled roller is a construction as regular cylinder having helical grooves on the surface of its casing, which cylinder rotates with uniform speed round its axis of symmetry arranged parallelly to the plane of the filaments running parallelly one to the other, so that these filaments contact this regular cylinder longitudinally to a generating line.

The hot profiled roller may also be replaced by a sectional heat treatment of the filaments having a thermally influenceable lateral bending resistance according to other methods, for example by a pulse irradiation with electromagnetic rays, for example in the infrared field. It is also possible to treat intermittantly the filament yarn with hot steam, so that the lateral bending resistance is reduced in determined sections to an extent which ensures formation of the desired free filament ends when transverse stress is applied.

When the yarn is blended of filaments having a thermally influenceable lateral bending resistance and filaments having a high lateral bending resistance, a protective twist may also be applied to the filament strand before passing it over the hot profiled roller, since the filaments having a high lateral bending resistance remain continuous and thus provide the necessary yarn strength. In the case where the yarn should entirely consist of filaments having a thermally influenceable lateral bending resistance, the filaments are preferably passed over the surface of the hot profiled roller in the form of an extended strand. In this case, the roller is advantageously constructed as regular cylinder having helical grooves and ridges on the surface of its casing, which cylinder rotates with uniform angular speed round its axis of symmetry arranged parallelly to the plane of the filaments running parallelly one to the other, so that these filaments contact this regular cylinder longitudinally to a generating line.

By filaments having a thermally influenceable lateral bending resistance there are to be understood those filaments the lateral bending resistance of which decreases considerably by a thermal treatment and attains values of below 500 cycles. Such filaments may for example be manufactured according to German Auslegeschriften Nos. 1,278,688, 1,237,727, 1,720,647 and British Pat. No. 667 089.

The lateral bending resistance is measured by means of the flex life tester as it is described for example by Grunewald in Chemiefasern 12 (1962), page 853. For testing the lateral bending resistance, the filaments are charged with 0.45 g/tex; the diameter of the wire being 0.02 mm for up to 6.7 dtex, 0.04 mm for up to 13 dtex, and 0.05 mm for stronger titers; the flexion is carried out at an angle of 110° at a speed of 126 cycles per minute.

The special shape of the profiled roller is adapted to the requirements put on the filament and depends on the filament and yarn titer, the raw material and the spinning speed. The dimensions, the place and number of the contact areas of the filaments and the profiled roller are determined according to the desired distribution and number of the defined breaks.

The temperature of the hot profiled roller determines the lateral bending resistance of the filaments having a thermally influenceable lateral bending resistance and thus the number of the breaking and protruding filament ends as well as the tendency to pilling of the woven or knitted fabrics manufactured therefrom. For example, the lateral bending resistance of the filaments having a thermally influenceable lateral bending resistance described in Example 1 drops from about 1000 cycles of the drawn filaments to about 500 revolutions by a heat treatment at 150° C and to about 220 cycles by a heat treatment at about 200° C.

The residence time of the filament sections on the surface of the profiled roller may be determined by a corresponding choice of the angle of contact, and of course of the draw-off speed.

A prolonged residence time causes also a drop of the lateral bending resistance and thus an increased hairiness of the multifilaments as desired, as well as a decreased tendency to pilling of the woven or knitted fabrics manufactured therefrom.

The transverse stress which causes a break of the filament sections having a low lateral bending resistance and thus the desired protruding filament ends may be effected by bending round an edge, by a twisting process as usual in the manufacture of yarns, or by false-twist texturizing. Preferred are false-twist texturizing processes, since they result in voluminous filament yarns having protruding filament ends.

The filament yarn having protruding filament ends manufactured according to the process of the invention corresponds substantially to a staple fiber yarn with respect to its aspect. But contrary to the known filament yarns having fiber yarn character, and contrary to the staple fiber yarns from synthetic high polymers, the filament yarn manufactured according to the process of the invention results in woven or knitted fabrics having a poor tendency to pilling.

The lateral bending resistance value has in influence on the number of the protruding filament ends produced in the process of the invention, since the filament sections of low lateral bending resistance break on account of the transverse stress. The number of protruding filament ends may also be influenced by the amount of filaments having a thermally influenceable lateral bending resistance in the complete filament yarn.

The tendency to pilling of woven fabrics decreases also considerably with dropping lateral bending resistance; but as can be already seen from the expression "lateral bending resistance", it is normally impossible to manufacture or use applicable filament yarns having a lateral bending resistance of for example zero. When woven or knitted fabrics or particularly low tendency to pilling are required, filaments having a lateral bending resistance of, for example, less than 5 cycles may be used.

Depending on the application, all filaments of the filament yarn may be filaments having a lateral bending resistance which may be considerably decreased by the sectional heat treatment by means of the hot profiled roller according to the process of the invention and thus form protruding filament ends after a transverse stress, or only part of the filaments have this property, while the other part has a high lateral blending resistance and does not break by the transverse stress put onto it.

In the first case, in order to attain a sufficient yarn strength, slightly tighter interlacing of the filaments has to be chosen, while in the latter case sufficient yarn strength is ensured anyway by the filaments. Filament yarns blended at 7 : 3 to 3 : 7 made from filaments having a thermally influenceable lateral bending resistance mixed with filaments the resistance of which exceeds 1500 (e.g. 3000 cycles), resulted in knotted or woven fabrics which excelled in especially attractive appearance and touch of the product and by excellent wear as well. Furthermore, titer, profile and number of the filaments, i.e. the total titer of the filament yarn used, may be chosen deliberately according to the desired application. Most often the titer will remain within the range of from 1 to 10 dtex per filament and of below 200 dtex for the yarn, appropriate for textile application purposes; however, special purposes such as decorative fabric may also require higher titers. The upper titer limit is given only by the texturizing process. In the case where different filaments are used to form a yarn, their titers and cross sections may differ as well; the filaments may also consist of diverse raw materials so that their diversified properties may contribute to realize further special effects such as additional bulk effects caused by different shrinkage, or such as those caused by use of mixture yarns or coloured twist yarns. On the other hand, the color affinity of the filaments may be adapted by suitable modifications.

Since in the process of the invention the filaments are homogeneously drawn before the break, a uniform dyeing over their complete length including the protruding filament ends is enseured, contrary to the known processes, where the break of the filaments occurs by overstretching in the drawing zone.

It is generally useful to mix the individual components while processing various filaments into a filament yarn. Mixing may take place at anyone of the different preliminary processing stages. For instance, the two kinds of filaments may be spun either from one single spinning nozzle or from two adjacent spinning nozzles as described — for example — in British Pat. No. 1,208,801. The different types of filaments may also be gathered during the drawing step. A further intense mixing may be achieved in any case by interlacing or electrostatic charge.

When the process of the invention is carried out by means of false-twist texturizing methods, there are generally preferred devices provided with false-twist spindles, since the deflection on the spindle has a still better effect on the formation of the filament ends than the only torsion stress in friction texturizing. The number of protruding filament ends depends for example also on such texturizing parameters as temperature, yarn tension before and after the spindle, finish application, number of spindle revolutions, running speed of the yarn, and the shape and surface of the spindle.

The break of the filament sections having a low lateral bending resistance yields a uniform distribution of the protruding filament ends over the complete length of the filament yarn. As compared thereto, in the known processes for the manufacture of hair yarns where the break of the filaments is caused by overstretching during the drawing step, there occurs easily a simultaneous break of numerous filament ends, which causes at least an irregular accumulation of protruding filament ends.

After the transverse stress put on, the broken filament ends partially still protrude too much from the filament yarn and, before a further processing, they should be integrated at least temporarily. Suitable processes for this purpose are all known processes for filament bonding, for example treatment with a sizing agent or interlacing. A preferred method for an increased filament bonding is the interlacing of the filaments immediately after leaving the false-twist texturizing step. Interlacing by blowing with gas jets generally replaces twisting more and more in the manufacture of synthetic filaments, since this may be carried out at high throughput rates and continuously, subsequent to other process steps. Such devices for interlacing are for example described in U.S. Pat. No. 2,985,995.

The open structure of the filament yarn may be fully maintained when the filament ends are bonded by applying a sizing agent which, after weaving or knitting, may be washed off again.

For their further processing, the filament yarns having protruding filament ends manufactured in accordance with the present invention are distinguished especially by their high uniformity of all textile technological properties over the complete length of the yarn. The most remarkable property of the woven or knitted fabrics manufactured from the filament yarns in accordance with the present invention is their low tendency to pilling.

The following examples illustrate the invention.

EXAMPLE 1

According to the process of the invention, a hair yarn was manufactured as blended yarn made from 12 continuous filaments having a titer of dtex 5.5 (partial yarn 67 f 12) and 40 filaments having a titer of dtex 1.68 (partial yarn 67 f 40), having protruding filament ends. The partial yarn 67 f 12 was prepared from a polyethylene terephthalate having a relative viscosity of 1.81 (measured at 25° C on a 1 weight % solution in phenol/-tetrachloro-ethane, volume ratio 3 : 2). The raw material for the partial yarn 67 f 40 was prepared in accordance with Example 1 of German Auslegeschrift No. 1,720,647; the 2.4 g of zinc acetate, however, being replaced by 3.1 g of manganese acetate, and the amount of trimethoxy-silane-ethanephosphonic acid diethyl ester being increased from 48 to 72 g. Both raw materials were spun according to U.S. Pat. No. 2,398,729 at 290° C through a spinning nozzle; the spun filaments being drawn off at a speed of 1400 m/min, and wound up. The relative viscosity of the spun filaments was 1.80 and 1.56. The elongation at break of the filaments at room temperature was 310 % for the coarse titer, and 375 % for the fine titer filaments; the double refractions were correspondingly at 9.3 and 6.6 . $10^{-3}$.

On a draw-twister, the blended undrawn filament was drawn over a hot pin having a temperature of 100° C and a hot plate having a temperature of 160° C, at a ratio of 1 : 3.45, and wound up at a rate of 600 m/min and 20 twists per meter. The drawn material had a uniform aspect without broken protruding filament ends.

The drawn blended filament yarn was texturized in a separate process step. According to the invention, at the entrance of the false-twist texturizing machine, there was mounted a rotating roller having a diameter of 60 mm, provided with 24 ridges uniformly distributed over the circumference at a distance angle of 15° (height of the ridge 4 mm at a width of 2 mm). The filament yarn fed in was passed over the heated roller at an angle of contact of 300°. The surface temperature was 200° C, the circumferential speed corresponded to the feeding rate of 147 m/min determined by the factor device of the single heater texturizing machine. At a setting temperature of the hot plate of 180° C, 2700 revolutions per meter and an overfeed of 1.5 %, breaks of the filaments having a filament titer of 1.7 dtex occurred in the determined sections of reduced transverse strength, which breaks were regularly distributed over the length of the filament yarn.

EXAMPLE 2

The blended spun filament yarn of Example 1 was again fed into the draw-twister. However, the roller of Example 1 was mounted at the outlet of the drawing device and turned at a circumferential speed of 100 m/min. Drawing was again carried out at a ratio of 1 : 3.45 at a draw-off speed of 100 m/min, so that the final product showed 100 twists per meter. The temperatures were as described in Example 1.

Because of the locally considerable decrease of transverse strength of the component of a filament titer of 1.7 dtex at the roller, on account of the stress put on the filament in the twist traveler (twist traveler HZ 23, ring diameter 100 mm), there occurred numerous broken protruding filament ends which gave the non-texturized yarn a fiber-like aspect.

What is claimed is:

1. A process for the manufacture of filament yarns having fine protruding filament ends, which comprises drawing the filaments, subjecting the drawn filaments, wherein at least part of the filaments consist of polymers the lateral bending resistance of which can be thermally influenced, to an intermittent sectional heat treatment along the length of said filaments thus ensuring that sections of the heat treated filaments have a low lateral bending resistance, and subsequently breaking these sections of low lateral bending resistance by bending around an edge, twisting or false twisting which causes formation of the desired free filament ends.

2. A process as claimed in claim 1, which comprises passing at least part of the filaments consisting of polymers having a thermally influenceable lateral bending resistance over the surface of a hot profiled roller the circumferential speed of which being the same as the speed of the running filaments, which causes sections of the filaments to contact intensely the surface of the hot profiled roller and thus to obtain a low lateral bending resistance, and subsequently breaking these sections having a low lateral bending resistance by bending around an edge, twisting or false twisting which causes the formation of free filament ends.

* * * * *